US008584466B2

(12) United States Patent
Bronson et al.

(10) Patent No.: US 8,584,466 B2
(45) Date of Patent: Nov. 19, 2013

(54) CIRCUMFERENTIALLY VARIED QUENCH JET ARRANGEMENT FOR GAS TURBINE COMBUSTORS

(75) Inventors: Thomas J. Bronson, Mesa, AZ (US); Frank J. Zupanc, Phoenix, AZ (US)

(73) Assignee: Honeywell International Inc., Morristown, NJ (US)

( * ) Notice: Subject to any disclaimer, the term of this patent is extended or adjusted under 35 U.S.C. 154(b) by 734 days.

(21) Appl. No.: 12/720,431

(22) Filed: Mar. 9, 2010

(65) Prior Publication Data

US 2011/0219774 A1 Sep. 15, 2011

(51) Int. Cl.
*F02C 1/00* (2006.01)
*F02G 3/00* (2006.01)

(52) U.S. Cl.
USPC ..... 60/752

(58) Field of Classification Search
USPC ..... 60/754, 733, 752, 746, 805, 39.821, 60/747
See application file for complete search history.

(56) References Cited

U.S. PATENT DOCUMENTS

| | | | | |
|---|---|---|---|---|
| 4,008,568 | A * | 2/1977 | Spears et al. | 60/796 |
| 4,151,713 | A * | 5/1979 | Faitani et al. | 60/747 |
| 6,145,319 | A * | 11/2000 | Burns et al. | 60/755 |
| 6,205,789 | B1 * | 3/2001 | Patterson et al. | 60/754 |
| 6,474,070 | B1 * | 11/2002 | Danis et al. | 60/739 |
| 6,810,673 | B2 * | 11/2004 | Snyder | 60/752 |
| 6,931,862 | B2 * | 8/2005 | Harris | 60/804 |
| 7,506,512 | B2 * | 3/2009 | Schumacher et al. | 60/754 |
| 7,954,325 | B2 * | 6/2011 | Burd et al. | 60/752 |
| 2008/0127651 | A1 * | 6/2008 | Zupanc et al. | 60/752 |
| 2009/0056338 | A1 * | 3/2009 | Cazalens et al. | 60/746 |
| 2009/0139239 | A1 * | 6/2009 | Zupanc et al. | 60/740 |

OTHER PUBLICATIONS

Arthur H. Lefebvre, Gas Turbine Combustion, 1998, CRC Press, 2 edition p. 178.*

* cited by examiner

*Primary Examiner* — Phutthiwat Wongwian
*Assistant Examiner* — William Breazeal
(74) *Attorney, Agent, or Firm* — Ingrassia Fisher & Lorenz, P.C.

(57) ABSTRACT

A combustor for a turbine engine is provided. The combustor includes a first liner; a second liner positioned relative to the first liner to form a combustion chamber therebetween, the combustion chamber configured to receive a fuel-air mixture; an igniter positioned relative to the combustion chamber and configured to ignite the fuel-air mixture; a first group of air admission holes positioned in the first liner and forming a regular circumferential pattern around the first liner; and a second group of air admission holes positioned in the first liner at a first circumferential position corresponding to the igniter, the second group of air admission holes departing from the regular circumferential pattern.

14 Claims, 5 Drawing Sheets

210

CIRCUMFERENTIALLY VARIED QUENCH JET ARRANGEMENT FOR GAS TURBINE COMBUSTORS

TECHNICAL FIELD

The present invention generally relates to gas turbine engine combustors, and more particularly, to quench jet arrangements for gas turbine engine combustors.

BACKGROUND

Gas turbine engines, such as those used to power modern commercial aircraft, typically include a compressor for pressurizing a supply of air, a combustor for burning a fuel in the presence of the pressurized air, and a turbine for extracting energy from the resultant combustion gases. The combustor typically includes radially spaced apart inner and outer liners that define an annular combustion chamber. A number of circumferentially distributed fuel injectors project into the forward end of the combustion chamber to supply the fuel to the combustion chamber. One or more rows of circumferentially distributed air admission holes penetrate each liner to admit air into the combustion chamber.

There is an increasing emphasis on the reduction of gaseous pollutant emissions that form during the combustion process of gas turbine engines, particularly oxides of nitrogen (NOx). One approach to reduce NOx emissions is the implementation of a rich burn, quick quench, lean burn (RQL) combustion concept. A combustor configured for RQL combustion includes the following three serially arranged combustion zones: a rich burn zone at the forward end of the combustor, a quick quench or dilution zone downstream of the rich burn zone, and a lean burn zone downstream of the quench zone. By precisely controlling the fuel to air ratios in each zone, high-temperature excursions can be reduced and the resulting NOx emissions can be minimized. The effectiveness of the RQL concept, however, is primarily dependent on the design of the quick quench section of the combustor where the fuel-rich gases from the rich burn zone are rapidly mixed with excess air and passed to the lean burn zone. The design and development of the quench zone geometry is one of the challenges in the successful implementation of low-emissions RQL combustors. However, some of the quench zone features that reduce NOx emissions may have a corresponding adverse impact on other engine operating characteristics. For example, hole arrangements that optimize NOx emissions by rapidly mixing the fuel with air may reduce high altitude ignition performance.

Accordingly, it is desirable to provide a combustor that balances improved NOx emissions with other advantageous operating characteristics. Furthermore, other desirable features and characteristics of the present invention will become apparent from the subsequent detailed description of the invention and the appended claims, taken in conjunction with the accompanying drawings and this background of the invention.

BRIEF SUMMARY

In accordance with an exemplary embodiment, a combustor for a turbine engine is provided. The combustor includes a first liner; a second liner positioned relative to the first liner to form a combustion chamber therebetween, the combustion chamber configured to receive a fuel-air mixture; an igniter positioned relative to the combustion chamber and configured to ignite the fuel-air mixture; a first group of air admission holes positioned in the first liner and forming a regular circumferential pattern around the first liner; and a second group of air admission holes positioned in the first liner at a first circumferential position corresponding to the igniter, the second group of air admission holes departing from the regular circumferential pattern.

In accordance with an exemplary embodiment, a combustor for a turbine engine is provided. The combustor includes a first liner; a second liner positioned relative to the first liner to form a combustion chamber therebetween; a first injector, a second injector, and a third injector, each configured to provide a fuel-air mixture to the combustion chamber, the first injector and the third injector each being positioned circumferentially adjacent to the second injector on opposite sides; an igniter having a position generally circumferentially aligned with the second injector and configured to ignite the fuel-air mixture in the combustion chamber; a first group of air admission holes positioned in the first liner at a first circumferential position corresponding to the first injector, the first group of air admission holes forming a first pattern; a second group of air admission holes positioned in the first liner at a second circumferential position corresponding to the second injector, the second group of air admission holes forming a second pattern, the second pattern being different from the first pattern; and a third group of air admission holes positioned in the first liner at a third circumferential position corresponding to the third injector and forming a third pattern, the third pattern being the same as the first pattern.

BRIEF DESCRIPTION OF THE DRAWINGS

The present invention will hereinafter be described in conjunction with the following drawing figures, wherein like numerals denote like elements, and wherein.

DETAILED DESCRIPTION

The following detailed description of the invention is merely exemplary in nature and is not intended to limit the invention or the application and uses of the invention. Furthermore, there is no intention to be bound by any theory presented in the preceding background of the invention or the following detailed description of the invention.

Exemplary embodiments described herein provide a rich-quench-lean gas turbine engine with a combustor that reduces NOx emissions. Particularly, the combustor may include air admission holes that are arranged in a primary pattern that produce desirable quench zone properties. Additionally, the combustor may include air admission holes that are circumferentially varied from the primary pattern at the igniters to provide improved ignition characteristics. For example, the air admission holes at the igniters may be arranged downstream of a position in the primary pattern that would otherwise optimize the combustor for NOx emissions. These circumferentially varied air admission holes provide desired ignition performance, particularly at high altitudes.

Figure 1:
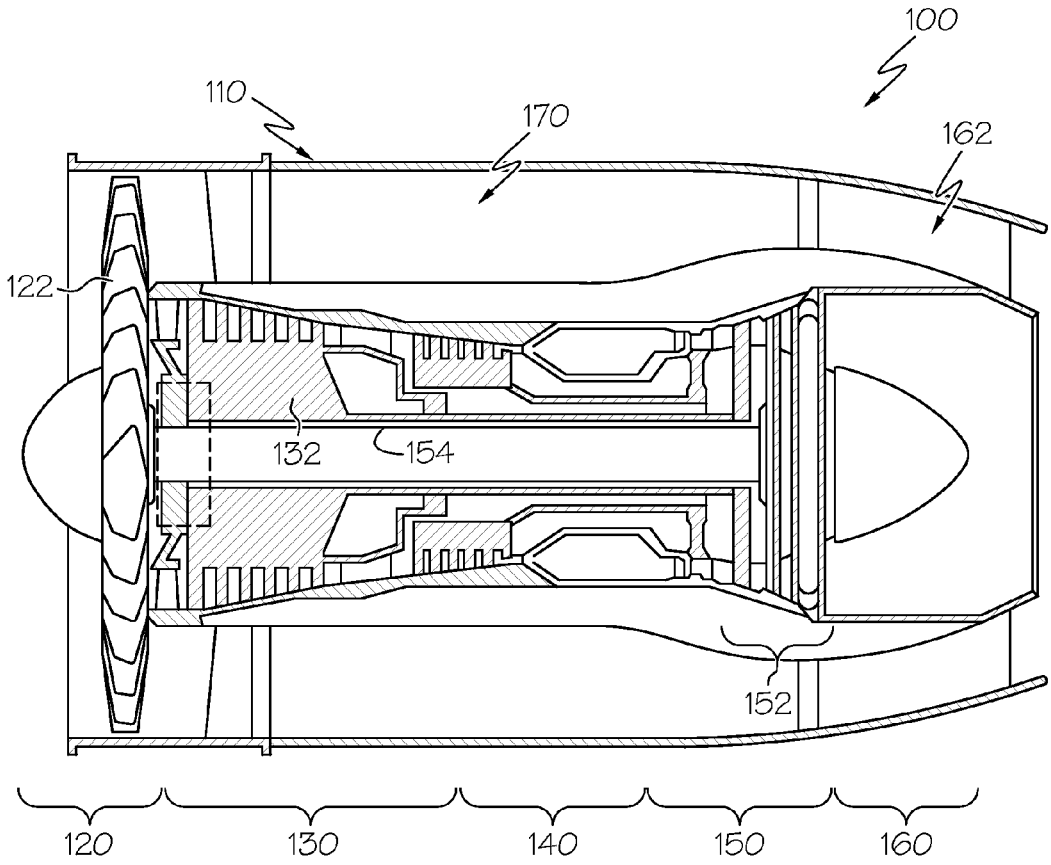
FIG. 1 is a cross-sectional view of a gas turbine engine in accordance with an exemplary embodiment.

FIG. 1 is a simplified, cross-sectional view of a gas turbine engine 100 according to an exemplary embodiment. The engine 100 may be disposed in an engine case 110 and may include a fan section 120, a compressor section 130, a combustion section 140, a turbine section 150, and an exhaust section 160. The fan section 120 may include a fan 122, which draws in and accelerates air. A fraction of the accelerated air exhausted from the fan 122 is directed through a bypass section 170 to provide a forward thrust. The remaining fraction of air exhausted from the fan 122 is directed into the compressor section 130.

The compressor section 130 may include a series of compressors 132, which raise the pressure of the air directed into it from the fan 122. The compressors 132 may direct the compressed air into the combustion section 140. In the combustion section 140, the high pressure air is mixed with fuel and combusted, as discussed in greater detail below. The combusted air is then directed into the turbine section 150.

The turbine section 150 may include a series of turbines 152 disposed in axial flow series. The combusted air from the combustion section 140 expands through and rotates the turbines 152. The air is then exhausted through a propulsion nozzle 162 disposed in the exhaust section 160, thereby providing additional forward thrust. In one embodiment, the turbines 152 rotate to thereby drive equipment in the engine 100 via concentrically disposed shafts or spools. Specifically, the turbines 152 may drive the compressor 132 via one or more rotors 154.

Figure 2:
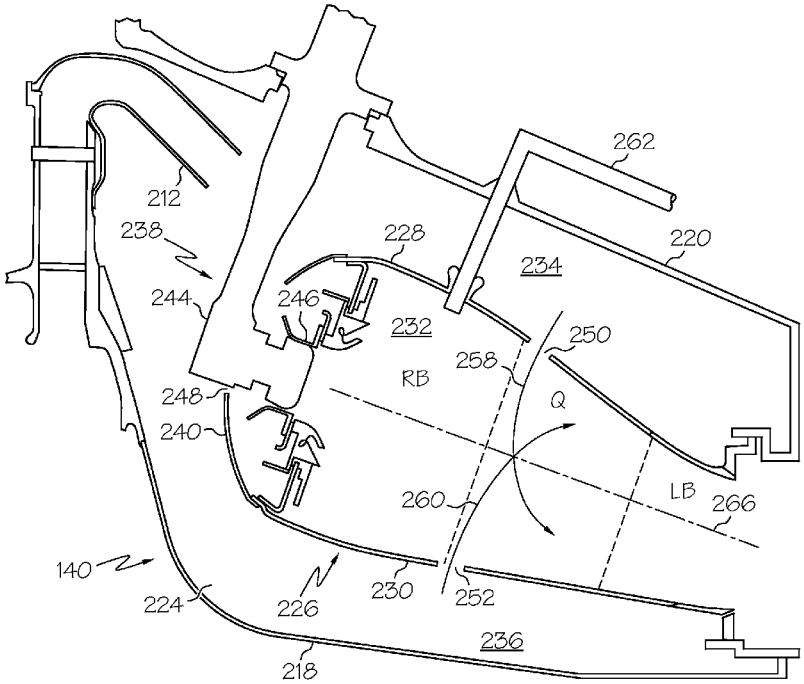
FIG. 2 is a partial, cross-sectional side elevation view of a combustor in the gas turbine engine of FIG. 1 in accordance with an exemplary embodiment.

FIG. 2 is a more detailed cross-sectional view of the combustion section 140 of FIG. 1 in accordance with an exemplary embodiment. In FIG. 2, only half the cross-sectional view is shown; the other half would be substantially rotationally symmetric about a centerline and axis of rotation, which typically corresponds to an axially extending engine centerline 210.

The combustion section 140 has a radially inner case 218 and a radially outer case 220 concentrically arranged with respect to the inner case 218. The inner and outer cases 218, 220 circumscribe the axially extending engine centerline 210 to define an annular pressure vessel 224. The combustion section 140 also includes a combustor 226 residing within the annular pressure vessel 224. The combustor 226 is defined by an outer liner 228 circumscribing an inner liner 230 to define an annular combustion chamber 232. The liners 228, 230 cooperate with cases 218, 220 to define respective outer and inner air plenums 234, 236.

The combustor 226 includes a front end assembly 238 having an annularly extending shroud 240, fuel injectors 244, and fuel injector guides 246. One fuel injector 244 and one fuel injector guide 246 are shown in the partial cross-sectional view of FIG. 2. In one embodiment, the combustor 226 includes a total of sixteen circumferentially distributed fuel injectors 244, but the combustor 226 can be implemented with more or fewer than this number of injectors 244.

The shroud 240 extends between and is secured to the forward-most ends of the outer and inner liners 228, 230. A plurality of circumferentially distributed shroud ports 248 accommodate the fuel injectors 244 and introduce air into the forward end of the combustion chamber 232. Each fuel injector 244 is secured to the outer case 220 and projects through one of the shroud ports 248, and each fuel injector 244 introduces a swirling, intimately blended fuel-air mixture that supports combustion in the combustion chamber 232. An igniter 262 extends through the outer plenum 234 to the outer liner 228 and is positioned to ignite the fuel-air mixture. In one exemplary embodiment, the combustor 226 includes two igniters 262, although the combustor 226 may be implemented with any number of igniters 262.

The depicted combustor 226 is a rich burn, quick quench, lean burn (RQL) combustor. During operation, a portion of the pressurized air flows through a diffuser 212 and enters a rich burn zone RB of the combustion chamber 232 by way of passages in the front end assembly 238. This air is referred to as primary combustion air because it intermixes with a stoichiometrically excessive quantity of fuel introduced through the fuel injectors 244 to support initial combustion in the rich burn zone RB.

The combustion products from the rich burn zone RB, which include unburned fuel, then enter a quench zone Q. Jets 258, 260 flow from the plenums 234, 236 and into the quench zone Q through the groups of air admission holes 250, 252 in the outer and inner liners 228, 230, respectively. The groups of air admission holes 250, 252 in the outer and inner liners 228, 230 are discussed in further detail below with reference to FIGS. 3-5. In various embodiments, the air admission holes 250, 252 may be flush, plunged or formed with inserts with the respect to the outer and inner liners 228, 230, and the combustor 226 may be a single or dual-wall liner combustor. Moreover, although only one row of air admission holes 250, 252 are respectively shown for the outer and inner liners 228, 230, additional rows of air admission holes may be provided as necessary or desired based on the considerations discussed herein.

The jets 258, 260 are referred to as quench air because they rapidly mix the combustion products from their stoichiometrically rich state at the forward edge of the quench zone Q to a stoichiometrically lean state at, or just downstream of, the aft edge of the quench zone Q. The quench air rapidly mixes with the combustion products entering the quench zone Q to support further combustion and release additional energy from the fuel. Since thermal NOx formation is a strong time-at-temperature phenomenon, it is important that the fuel-rich mixture passing through the quench zone be mixed rapidly and thoroughly to a fuel-lean state in order to avoid excessive NOx generation. Thus, the design of the quench air jet arrangement in an RQL combustor is important to the successful reduction of NOx levels.

Finally, the combustion products from the quench zone Q enter a lean burn zone LB where the combustion process concludes. As the combustion products flow into the lean burn zone LB, the air jets 258, 260 are swept downstream and also continue to penetrate radially and spread out laterally and intermix thoroughly with the combustion gases. As noted above, the combustion products from the lean burn zone LB flow into the turbine section 130 (FIG. 1) for power extraction.

Figure 3:
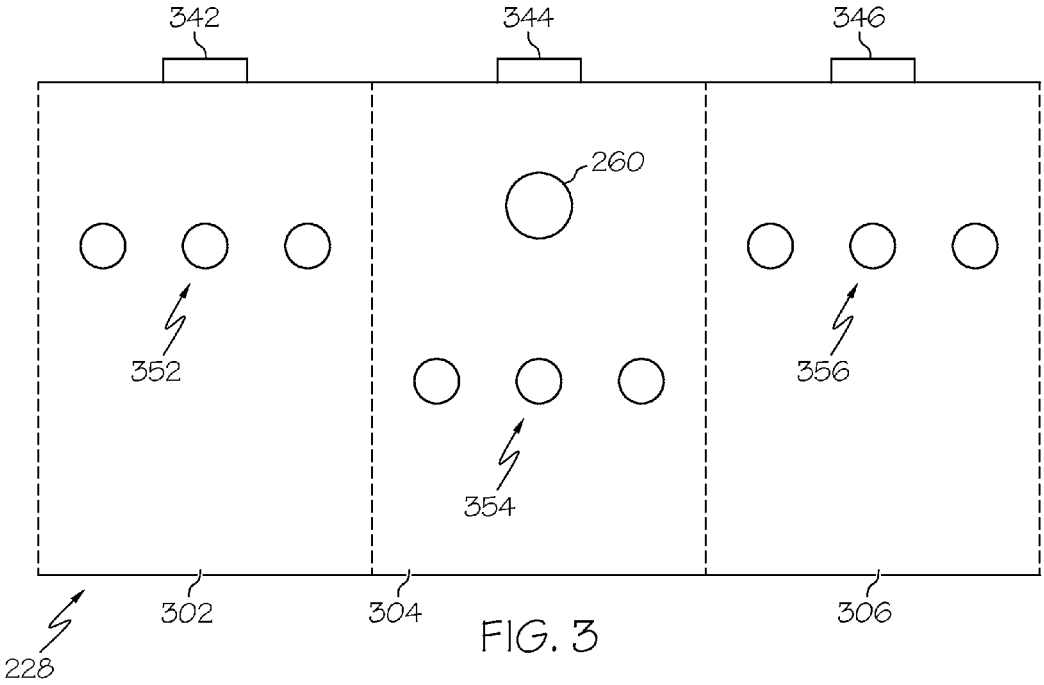
FIG. 3 is a partial, plan view of an outer liner of the combustor of FIG. 2 in accordance with a first exemplary embodiment.

FIG. 3 is a plan view of a portion of the outer liner 228 in accordance with an exemplary embodiment. Generally, the outer liner 228 can be considered a series of regions, e.g., regions 302, 304, 306. Each region 302, 304, 306 is associated with an injector, e.g., injectors 342, 344, 346, that generally corresponds to the injector 244 of FIG. 2. As noted above, the injectors 342, 344, 346 admit a swirling mixture of air and fuel for combustion. In the view of FIG. 3, first, second, and third regions 302, 304, 306 are shown, although as discussed above, sixteen or any other number of suitable regions may be provided in the outer liner 228.

Each of the regions 302, 304, 306 has a group of air admission holes 352, 354, 356 that generally correspond to the air admission holes 250 that admit jets into the quench zone Q of the combustor 226, as discussed above in reference to FIG. 2.

Although the arrangement of air admission holes 352, 354, 356 is discussed with reference to the combustor 226 of FIG. 2, the arrangement may be incorporated into any suitable combustor.

FIG. 3 also illustrates the circumferential position of an igniter 360. As noted above, two such igniters 360 may arranged around the outer liner 228, although any suitable number of igniters may be provided. As such, the second region 304 of the outer liner 228 is depicted as being circumferentially aligned with the igniter 360, while the first and third regions 302, 306 are not.

As discussed above, the air admission holes 352, 354, 356 may be arranged to balance NOx emissions and ignition performance. In the depicted embodiment, the air admission holes 352, 356 of the regions that are not aligned with an igniter 360, such as the first and third regions 302, 306, are arranged in a particular pattern to reduce NOx emissions. As such, the air admission holes 352, 356 of these regions 302, 306 are positioned in an upstream position to quickly quench the fuel-air mixture and prevent undesired NOx production. The pattern of the air admission holes 352, 356 in these regions 302, 306 generally corresponds to the primary pattern of the air admission holes around the circumference of most of the outer liner 228. In the depicted embodiment, the primary pattern of the air admission holes 352, 356 is a straight line in a designated axial position to produce the desired NOx characteristics, but any regular pattern may be provided.

In contrast to air admission holes 352, 356, the air admission holes 354 of the second region 304 and other regions with an igniter 360 are circumferentially varied from the primary pattern of the rest of the outer liner 228. In this exemplary embodiment, the air admission holes 354 are at a downstream axial position from the primary pattern to improve ignition performance. By providing less air around the igniter 360, the combustor 226 provides more reliable starts in high altitude situations. As such, the air admission holes (e.g., air admission holes 352, 356) may have a primary, repeated pattern around the outer liner 228; however, this pattern may be interrupted or otherwise varied in circumferential positions corresponding to the igniters (e.g., air admission holes 354 around the igniter 360) to provide an advantageous balance between NOx emissions and ignition performance.

Figure 4:
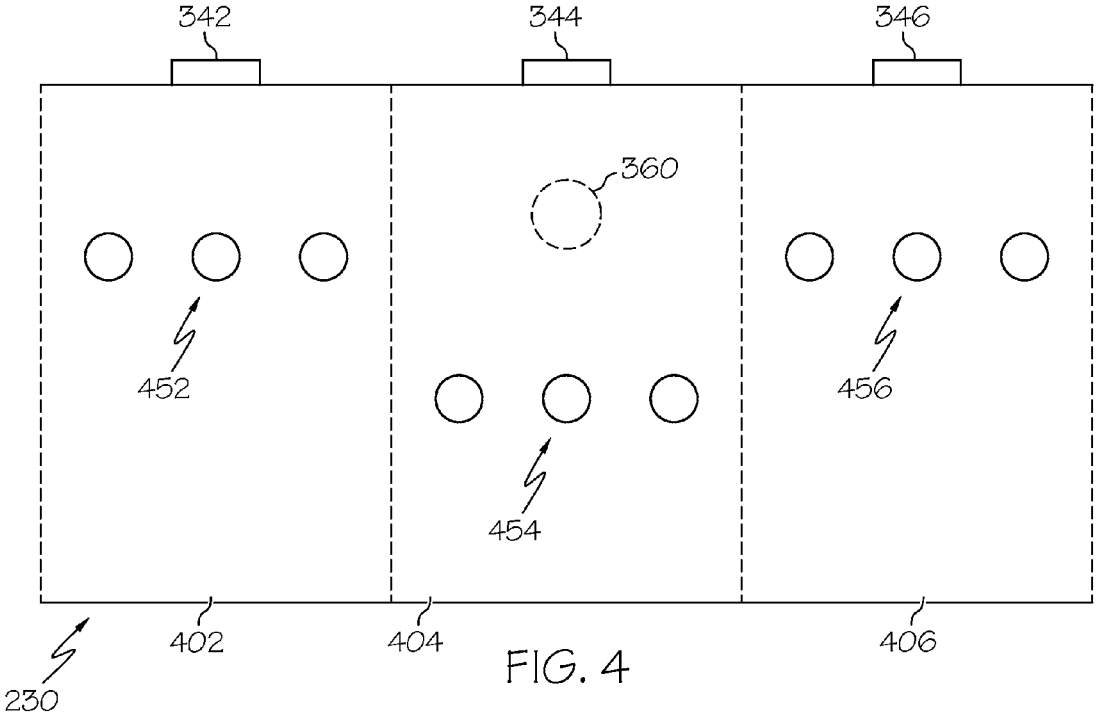
FIG. 4 is a partial, plan view of an inner liner of the combustor of FIG. 2 in accordance with a first exemplary embodiment.

FIG. 4 is a plan view of a portion of the inner liner 230 in accordance with an exemplary embodiment that cooperates with the outer liner 228 of FIG. 3. As with the outer liner 228, the inner liner 230 can be considered a series of regions, e.g., regions 402, 404, 406, associated with an injector, e.g., injectors 342, 344, 346. Although the igniter 360 is arranged in the outer liner 228 (FIGS. 2 and 3), FIG. 4 illustrates the approximate position of the igniter 360 relative to the inner liner 230.

Each of the regions 402, 404, 406 has a group of air admission holes 452, 454, 456 that generally correspond to the air admission holes 252 that admit jets into the quench zone Q of the combustor 226 as discussed above in reference to FIG. 2. The air admission holes 452 in region 402 generally cooperate with the air admission holes 352 of region 302 (FIG. 3) to radially span the quench zone Q of the combustion chamber 232 (FIG. 2), as do the air admission holes 454, 456 and air admission holes 354, 356, respectively.

As discussed above, the air admission holes 452, 454, 456 may be arranged to balance NOx emissions and ignition performance. In the depicted embodiment, the air admission holes 452, 456 of the regions 402, 406 that are not aligned with the igniter 360 are arranged in a particular pattern to reduce NOx emissions. As such, the air admission holes 452, 456 of these regions 402, 406 are positioned in an upstream position to quickly quench the fuel-air mixture and prevent undesired NOx production. The pattern of the air admission holes 452, 456 in these regions 402, 406 generally corresponds to the primary pattern of the air admission holes around the circumference of the inner liner 230. In the depicted embodiment, the pattern of the air admission holes 452, 456 is a straight line in a designated axial position to produce the desired NOx characteristics, but any regular pattern may be considered.

In contrast to air admission holes 452, 456, the air admission holes 454 of the region 404 and other regions with an igniter 360 are circumferentially varied from the primary pattern of the rest of the inner liner 230. In this exemplary embodiment, the air admission holes 454 are at a downstream axial position from the primary pattern to improve ignition performance. As noted above, by providing less air around the igniter 360, the combustor 226 provides more reliable starts in high altitude situations. This arrangement particularly enlarges the primary zone volume, thereby reducing the primary zone loading and increasing residence time, both of which enhance ignition, particularly at high altitudes. As such, the air admission holes (e.g., air admission holes 452, 456) may have a primary, repeated pattern around the inner liner 230, although this pattern may be interrupted or otherwise varied in circumferential positions corresponding to the igniters (e.g., air admission holes 454 around the igniter 360) to provide an advantageous balance between NOx emissions and ignition performance.

Figure 5:
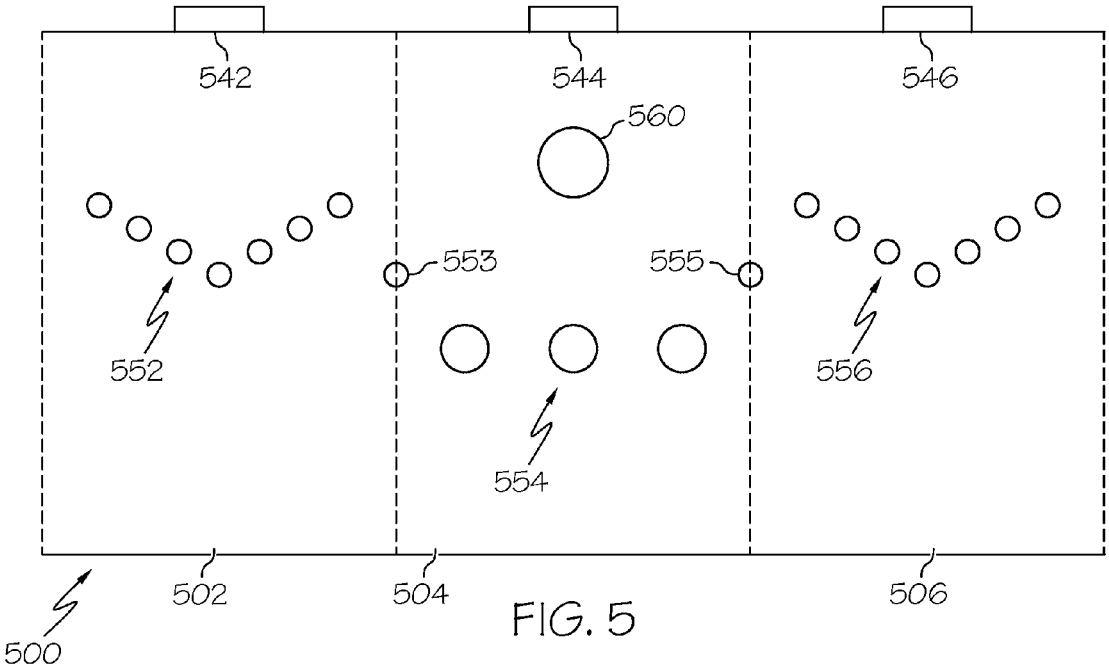
FIG. 5 is a partial, plan view of a combustor liner of the combustor of FIG. 2 in accordance with an alternate exemplary embodiment.

FIG. 5 is a partial, plan view of a liner 500 of the combustor of FIG. 2 in accordance with an alternate exemplary embodiment. The liner 500 may be an inner or outer liner, such as the outer and inner liners 228, 230. As in the embodiments above, the liner 500 of FIG. 5 may be considered a series of regions 502, 504, 506 associated with an injector 542, 544, 546. Each of the regions 502, 504, 506 has a group of air admission holes 552, 554, 556 that admit jets into the quench zone Q of the combustor as discussed above in reference to FIG. 2. FIG. 5 also illustrates the approximate position of an igniter 560.

As in the embodiments above, the air admission holes 552, 556 of regions 502, 506 without an igniter 560 are arranged in a regular pattern to reduce NOx emissions. In this embodiment, the pattern of air admission holes 552, 556 is V-shaped to accommodate outside-in swirler flowfield patterns of the injectors 542, 546. Other circumferential patterns may be provided, including those with different sized holes and different numbers of holes.

In contrast to air admission holes 552, 556, the air admission holes 554 of the region 504 and other regions with an igniter 560 are circumferentially varied from the primary pattern of the rest of the outer liner 228. In this exemplary embodiment, the air admission holes 554 are at a downstream axial position from the primary pattern to improve ignition performance. In addition to the downstream holes, the group of air admission holes 554 also includes transition holes 553, 555 to provide a smooth transition with the primary pattern of the air admission holes 552, 556. Any number of transition holes 553, 555 in any suitable pattern may be provided.

As noted above, the regular circumferential pattern may generally be any suitable patterns of air admission holes, including straight circumferential lines, V-shaped patterns with various hole sizes and spacings, and modifications of such. Unless otherwise interrupted, the regular pattern may be formed by repeating pattern portions. For example, in the exemplary embodiment of FIG. 5, the regular pattern includes a V-shaped portion of holes 552. In some exemplary embodiments, the portions of the regular pattern correspond to equal spacing between injectors, e.g., in FIG. 5, one of the portions is in region 502 and another is in region 506. Similarly, the circumferentially varied air admission holes may also be arranged within a single liner region, such as the air admission holes 554 in region 504 of FIG. 5. However, the circumferentially varied air admission holes may also extend beyond a single region. For example, in one exemplary embodiment, the circumferentially varied air admission holes may span a portion of adjacent regions, such as the region with the igniter and about half of each of the adjacent regions.

Exemplary embodiments described herein provide a gas turbine engine with a combustor that produces reduced NOx emissions while also improving ignition performance. Particularly, in one exemplary embodiment, the combustor includes inner and outer liners with a primary pattern of air admission holes to reduce NOx emissions, while some air admission holes are circumferentially varied at the igniters to improve ignition performance. Although the combustors described above are RQL combustors, the circumferentially varied air admission holes may be incorporated into any type of combustor.

While at least one exemplary embodiment has been presented in the foregoing detailed description of the invention, it should be appreciated that a vast number of variations exist. It should also be appreciated that the exemplary embodiment or exemplary embodiments are only examples, and are not intended to limit the scope, applicability, or configuration of the invention in any way. Rather, the foregoing detailed description will provide those skilled in the art with a convenient road map for implementing an exemplary embodiment of the invention. It being understood that various changes may be made in the function and arrangement of elements described in an exemplary embodiment without departing from the scope of the invention as set forth in the appended claims.

What is claimed is:

1. A combustor for a turbine engine, comprising:

a first liner;

a second liner positioned relative to the first liner to form a combustion chamber therebetween, the combustion chamber configured to receive a fuel-air mixture;

an igniter positioned relative to the combustion chamber and configured to ignite the fuel-air mixture;

air admission holes positioned in the first liner and configured to admit combustion air into the combustion chamber;

a plurality of injectors configured to generate the fuel-air mixture for the combustion chamber, wherein each injector defines a region of the first liner, and wherein at least one of the regions is circumferentially associated with the igniter to form at least one igniter region and a plurality of non-igniter regions, wherein the air admission holes have a regular circumferential pattern around the first liner in each of the non-igniter regions and an interrupted circumferential pattern in the at least one igniter region, different from the regular circumferential pattern, wherein the air admission holes in the at least one igniter region are positioned axially downstream of the air admission holes in the non-igniter regions.

2. The combustor of claim 1, wherein the regular circumferential pattern is a generally straight line.

3. The combustor of claim 2, wherein the air admission holes in the at least one igniter region are positioned in a generally straight line.

4. The combustor of claim 1, wherein regular circumferential pattern includes pattern portions that are V-shaped.

5. The combustor of claim 4, wherein the air admission holes in the at least one igniter region are positioned in a circumferential, generally straight line.

6. The combustor of claim 1, wherein the first liner is an outer liner.

7. The combustor of claim 1, wherein the air admission holes in the non-igniter regions are flush with the first liner.

8. The combustor of claim 1, wherein the air admission holes in the non-igniter regions includes holes with varying sizes.

9. The combustor of claim 1, wherein the air admission holes in the non-igniter regions have a first diameter and the air admission holes in the at least one igniter region have has a second diameter, different from the first diameter.

10. A combustor for a turbine engine, comprising:

a first liner;

a second liner positioned relative to the first liner to form a combustion chamber therebetween, the combustion chamber configured to receive a fuel-air mixture;

an igniter positioned relative to the combustion chamber and configured to ignite the fuel-air mixture;

air admission holes positioned in the first liner and configured to admit combustion air into the combustion chamber;

a plurality of injectors configured to generate the fuel-air mixture for the combustion chamber, wherein each injector defines a region of the first liner, and wherein at least one of the regions is circumferentially associated with the igniter to form at least one igniter region and a plurality of non-igniter regions, wherein the air admission holes have a regular circumferential pattern around the first liner in each of the non-igniter regions and an interrupted circumferential pattern in the at least one igniter region, different from the regular circumferential pattern, wherein the first liner is an inner liner.

11. A combustor for a turbine engine, comprising:

a first liner;

a second liner positioned relative to the first liner to form a combustion chamber therebetween;

a first injector, a second injector, and a third injector, each configured to provide a fuel-air mixture to the combustion chamber, the first injector and the third injector each being positioned circumferentially adjacent to the second injector on opposite sides;

an igniter having a position generally circumferentially aligned with the second injector and configured to ignite the fuel-air mixture in the combustion chamber;

a first group of air admission holes positioned in the first liner at a first circumferential position corresponding to the first injector, the first group of air admission holes forming a first pattern;

a second group of air admission holes positioned in the first liner at a second circumferential position corresponding to the second injector, the second group of air admission holes forming a second pattern, the second pattern being different from the first pattern; and a third group of air admission holes positioned in the first liner at a third circumferential position corresponding to the third injector and forming a third pattern, the third pattern being the same as the first pattern, wherein the first, second, and third groups of air admission hole are each configured to admit combustion jets into the combustion chamber, wherein the second pattern is a generally straight line axially downstream of the first pattern and the third pattern.

12. The combustor of claim 11, wherein the second group of air admission holes are positioned axially downstream of the first group of air admission holes and the third group of air admission holes.

13. The combustor of claim 11, wherein the first pattern and the third pattern are generally straight lines.

14. The combustor of claim 11, wherein the first pattern and the third pattern are generally V-shaped.

* * * * *